US007540497B2

(12) United States Patent
Tseng

(10) Patent No.: US 7,540,497 B2
(45) Date of Patent: Jun. 2, 2009

(54) AUTOMATIC CARD SHUFFLER

(76) Inventor: Kuo-Lung Tseng, 15/F., No. 367, Hankou Rd., Sec. 4, Taichung City (TW)

( * ) Notice: Subject to any disclaimer, the term of this patent is extended or adjusted under 35 U.S.C. 154(b) by 104 days.

(21) Appl. No.: 11/898,518

(22) Filed: Sep. 13, 2007

(65) Prior Publication Data

US 2009/0072477 A1 Mar. 19, 2009

(51) Int. Cl.
*A63F 9/08* (2006.01)

(52) U.S. Cl. ..... 273/149

(58) Field of Classification Search ..... 273/149 R
See application file for complete search history.

(56) References Cited

U.S. PATENT DOCUMENTS 4,832,342 A * 5/1989 Plevyak et al. ..... 273/149 R
5,445,377 A * 8/1995 Steinbach ..... 273/149 R
6,250,632 B1 * 6/2001 Albrecht ..... 273/149 R
6,651,981 B2 * 11/2003 Grauzer et al. ..... 273/149 R
6,651,982 B2 * 11/2003 Grauzer et al. ..... 273/149 R
7,066,464 B2 * 6/2006 Blad et al. ..... 273/149 R

* cited by examiner

*Primary Examiner*—Gene Kim
*Assistant Examiner*—Dolores Collins
(74) *Attorney, Agent, or Firm*—Rosenberg, Klein & Lee

(57) ABSTRACT

An automatic card shuffler includes two parallel stands, two conveying units respectively mounted in the stands for conveying playing cards out of the associating stands toward a space between the stands, two limiters respectively mounted in the stands for holding playing cards for delivery by the conveying units individually, a card carrier unit set between the stands and controllable to lift a holder plate for collecting playing cards delivered from the conveying units, a constraint mechanism set between the stands for holding playing cards on the holder plate in a stack, and a card dispensing mechanism disposed above the stands for pushing playing cards out of the holder plate of the card carrier unit toward the baffles of the limiters in the working spaces of the stands alternatively.

3 Claims, 5 Drawing Sheets

AUTOMATIC CARD SHUFFLER

BACKGROUND OF THE INVENTION

1. Field of the Invention

The present invention relates to card shuffler and more particularly, to an automatic card shuffler for automatically randomly shuffling playing cards several times.

2. Description of the Related Art

Many card shufflers are known for randomly shuffling packs of playing cards. However, when one pack of playing cards is shuffled once, the dealer needs to pick up the primarily shuffled pack of playing cards from the card shuffler and then insert the primarily shuffled pack of playing cards into the card shuffler again for a secondary shuffling. Therefore, these card shufflers require much labor and cannot eliminate shuffle trick.

SUMMARY OF THE INVENTION

The present invention has been accomplished under the circumstances in view. It is the main object of the present invention to provide an automatic card shuffler, which can automatically and randomly shuffle playing cards many times.

To achieve this and other objects of the present invention, the automatic card shuffler comprises automatic card shuffler includes two parallel stands, two conveying units respectively mounted in the stands for conveying playing cards out of the associating stands toward a space between the stands, two limiters respectively mounted in the stands for holding playing cards for delivery by the conveying units individually, a card carrier unit set between the stands and controllable to lift a holder plate for collecting playing cards delivered from the conveying units, a constraint mechanism set between the stands for holding playing cards on the holder plate in a stack, and a card dispensing mechanism disposed above the stands for pushing playing cards out of the holder plate of the card carrier unit toward the baffles of the limiters in the working spaces of the stands alternatively.

DETAILED DESCRIPTION OF THE PREFERRED EMBODIMENT

Figure 1:
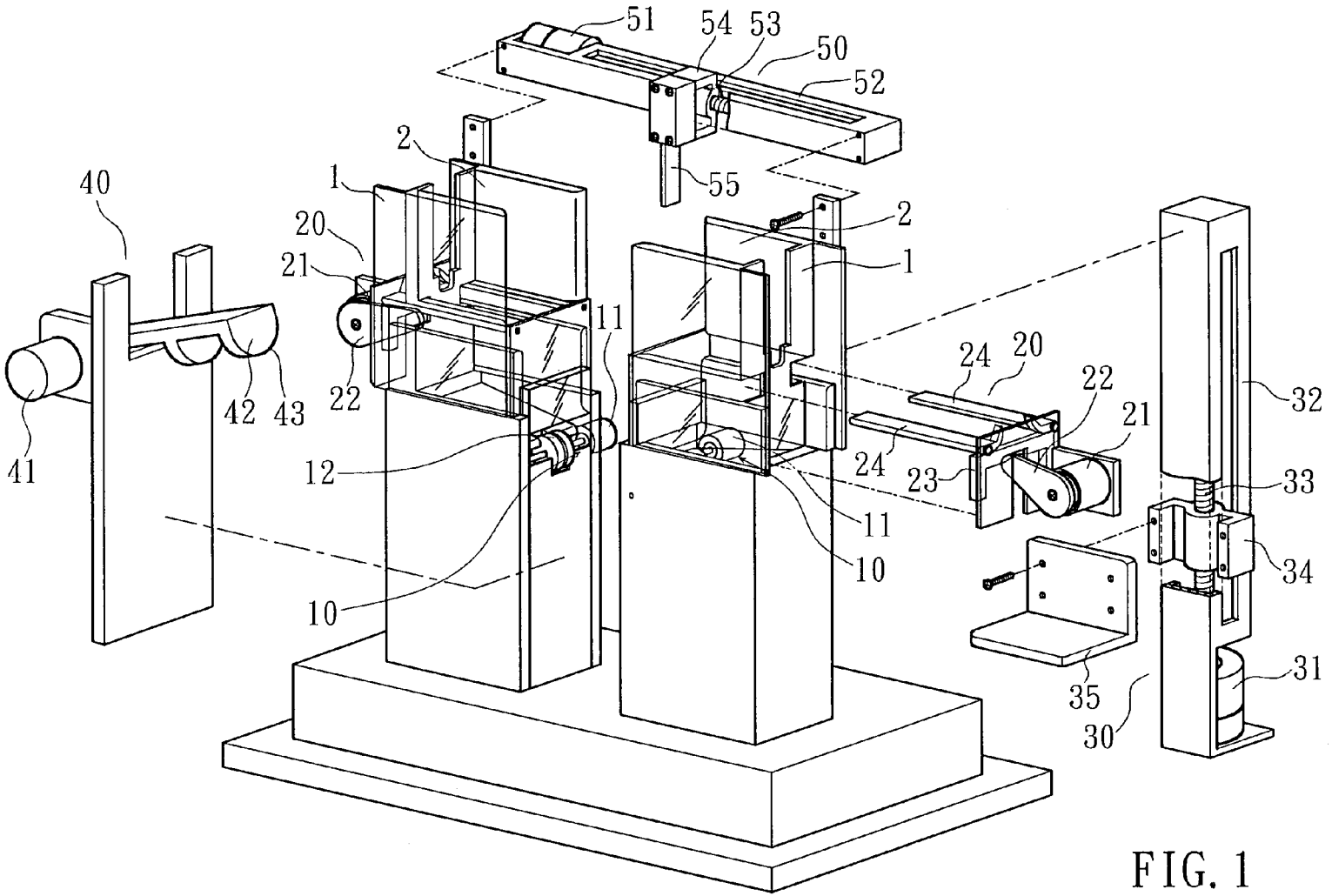
FIG. 1 is an exploded view of an automatic card shuffler in accordance with the present invention.
Figure 2:
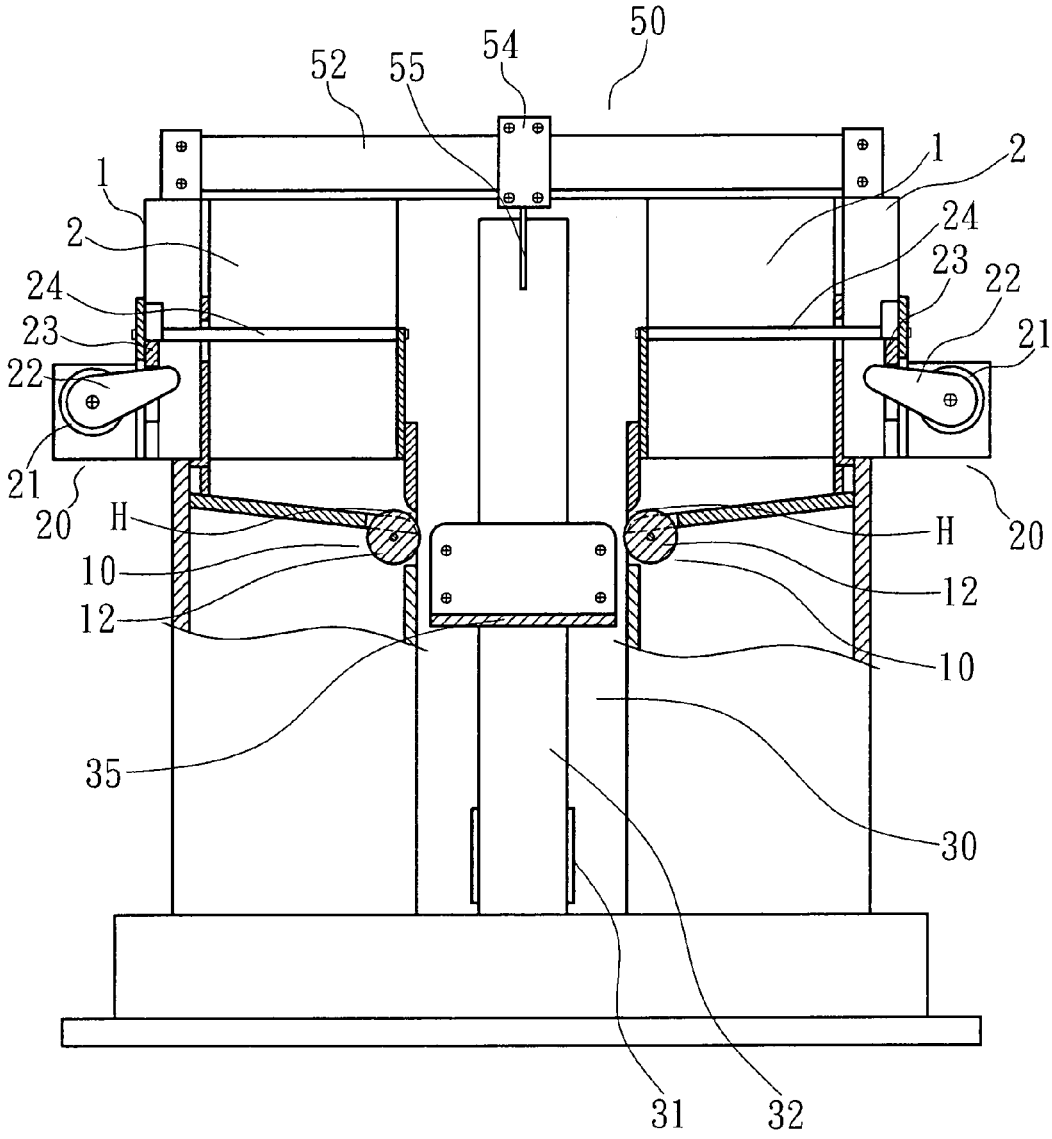
FIG. 2 is a sectional assembly view of the automatic card shuffler in accordance with the present invention.
Figure 3A:
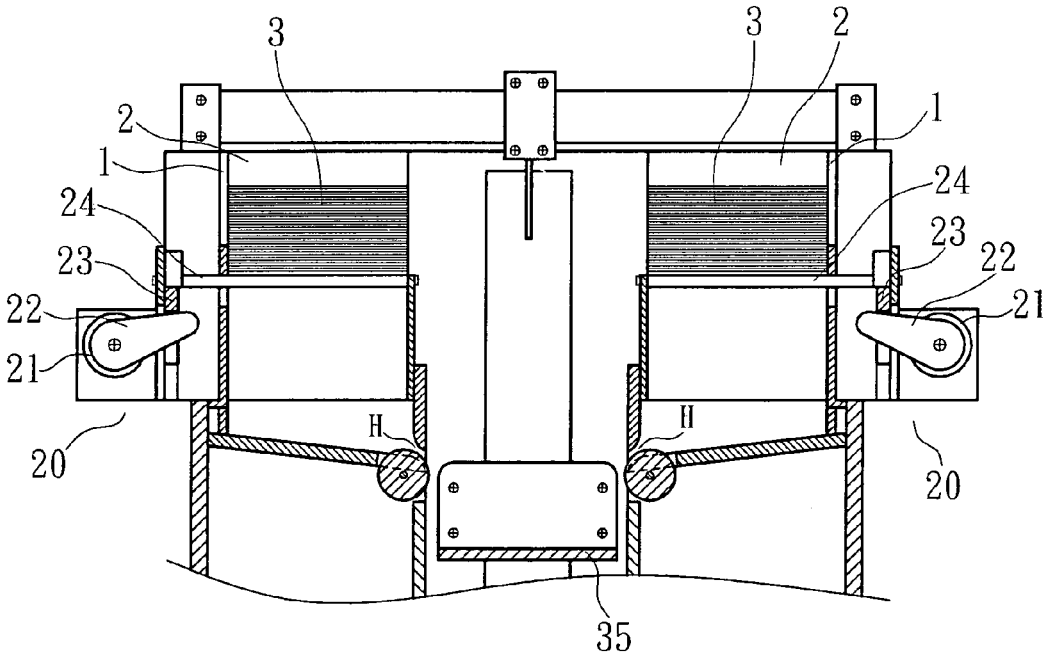
FIG. 3A is a front view of the present invention, showing the initial status of the automatic card shuffler.
Figure 3B:
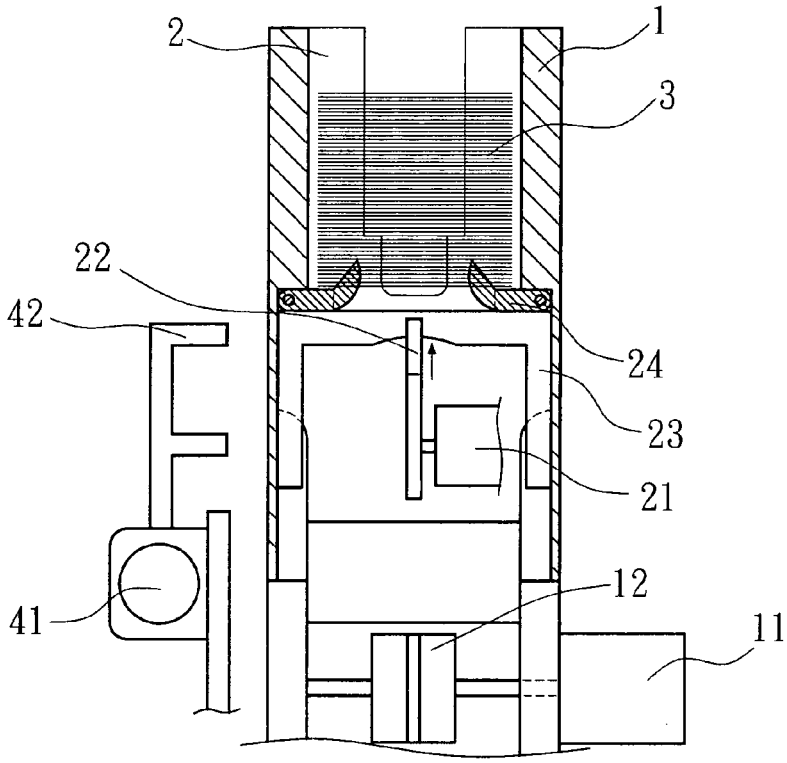
FIG. 3B is a sectional right side view of the present invention, showing the initial status of the automatic card shuffler.

Referring to FIGS. 1~6, an automatic card shuffler in accordance with the present invention is shown comprised of two transparent stands 1, two conveying units 10, two limiters

20, a card carrier unit 30, a constraint mechanism 40, and a card dispensing mechanism 50.

The conveying units 10 are respectively mounted in the transparent stands 1, each comprising a motor 11, and two conveying wheels 12 coupled to the motor 11 for conveying playing cards 3.

The two limiters 20 are respectively mounted in the transparent stands 1 at an outer side, each comprise a motor 21, a lifting frame 23, an actuating bar 22 coupled to the motor 21 and driven by the motor 21 to lift the lifting frame 23, and two baffles 24 bilaterally pivoted to the lifting frame 23 and inserted into the associating transparent stand 1 for holding playing cards 3 in a working space 2 inside the associating transparent stand 1 above the conveying wheels 12 of the associating conveying unit 10. When the baffles 24 are biased, playing cards 3 fall from the baffles 24 to the conveying wheels 12 of the associating conveying unit 10.

The card carrier unit 30 is set between the transparent stands 1, comprising a vertical sliding track 32, a motor 31 vertically disposed at the bottom side of the vertical sliding track 32, a vertical screw rod 33 coupled to the motor 31 and disposed in parallel to the vertical sliding track 32, a slide 34 coupled to the vertical screw rod 33 and movable along the vertical sliding track 32 upon rotation of the motor 31, and a holder plate 35 affixed to the slide 34 for carrying playing cards 3.

The constraint mechanism 40 is set between the transparent stands 1, comprising a motor 41, a constraint arm 42 coupled to the motor 41 and turnable by the motor 41 toward the holder plate 35 to hold playing cards 3 on the holder plate 35 neatly in a stack. The constraint arm 42 has two arched constraint portions 43 for holding playing cards 3 on the holder plate 35 neatly in a stack.

The card dispensing mechanism 50 is disposed at the top side of the transparent stands 1, comprising a horizontal sliding track 52, a motor 51 horizontally mounted in one end of the horizontal sliding track 52, a horizontal screw rod 53 coupled to the motor 51 and disposed in parallel to the horizontal screw rod 53, a slide 54 coupled to the horizontal screw rod 53 and movable along the horizontal sliding track 52 upon rotation of the motor 51, and a push bar 55 affixed to the bottom side of the slide 54 and adapted to push playing cards 3 out of the holder plate 35 into the working spaces 2 of the transparent stands 1 alternatively.

Figure 4A:
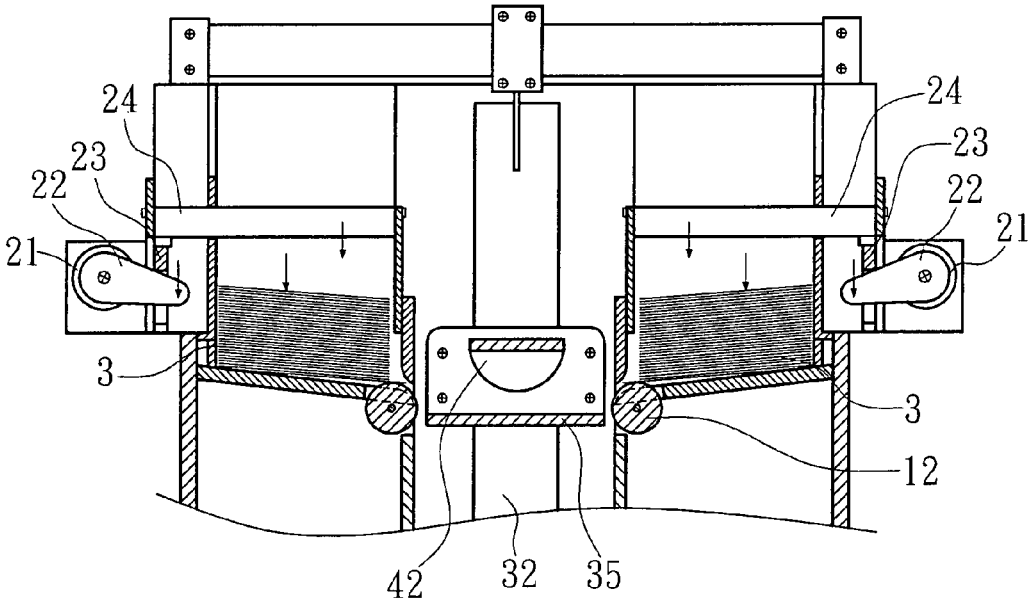
FIG. 4A is similar to FIG. 3A but showing playing cards dropped to the shuffling position.
Figure 4B:
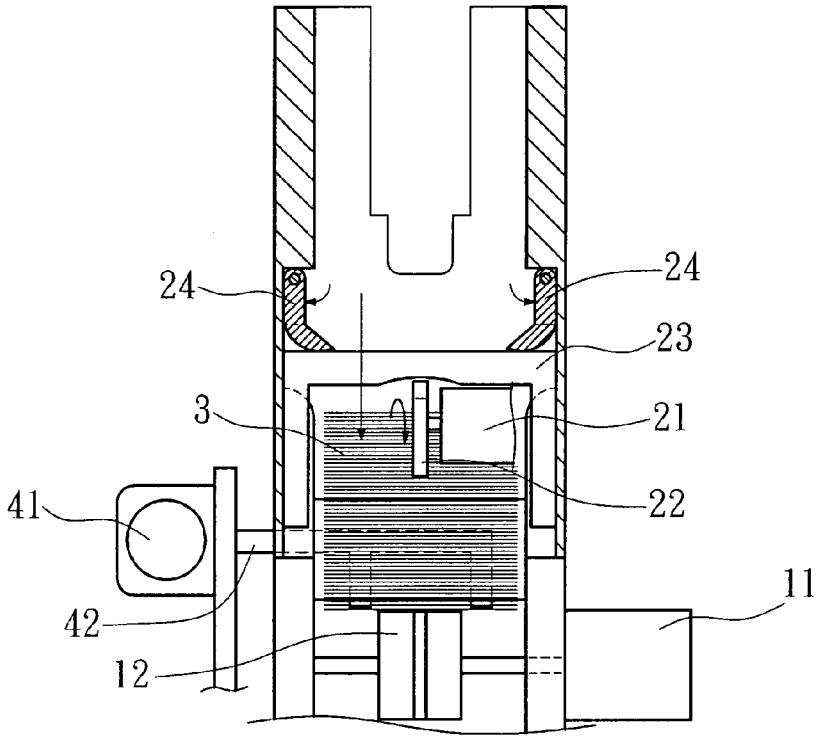
FIG. 4B is similar to FIG. 3B but showing playing cards dropped to the shuffling position.
Figure 5:
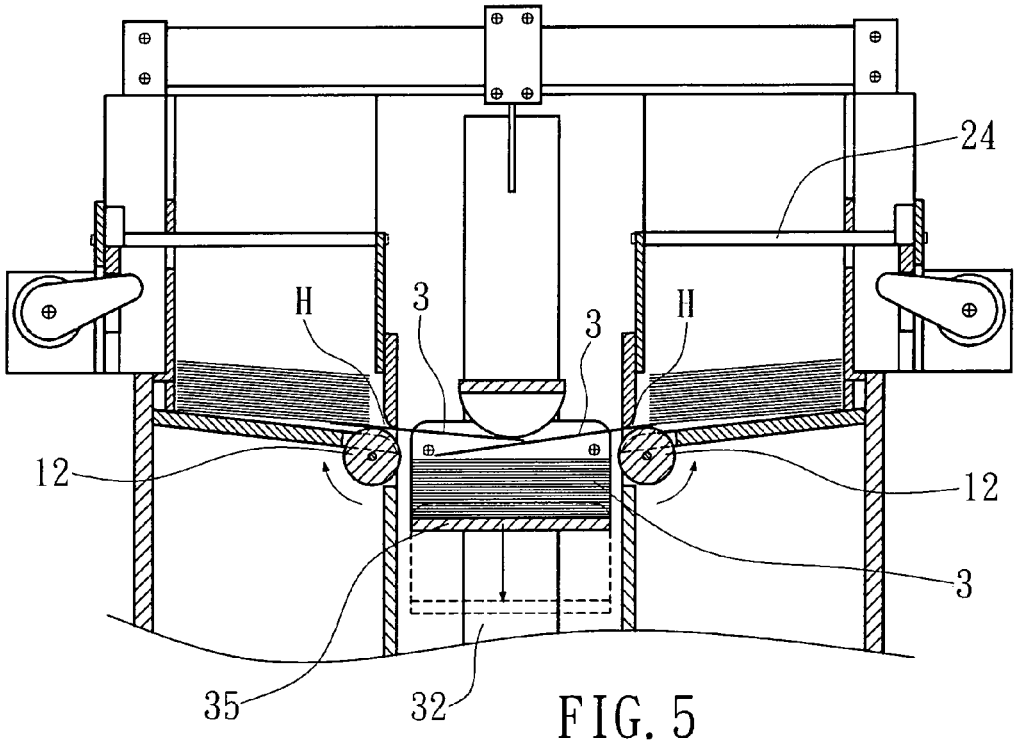
FIG. 5 is a schematic sectional view of the present invention, showing a card shuffling status of the automatic card shuffler.

The operation of the automatic card shuffler is outlined hereinafter with reference to FIGS. 3A, 3B, 4A, and 4B, playing cards 3 are inserted into the working space 2 in each of the transparent stands 1 and carried on the baffles 24 of the limiters 20. At this time, the actuating bar 22 is held in an upwardly tilted position. When the motor 21 of one limiter 20 is started to turn the associating actuating bar 22 downwards through an angle, as shown in FIGS. 4A and 4B, the associating lifting frame 23 is lowered, and the associating baffles 24 are biased downwards to let playing cards 3 fall to the conveying wheels 12 of the associating conveying unit 10. At this time, the holder plate 35 of the card carrier unit 30 is disposed adjacent to the conveying wheels 12. When shuffling playing cards 3, as shown in FIG. 5, the motor 11 of each conveying unit 10 is started to rotate the associating conveying wheels 12, carrying playing cards 3 one after another in a proper order through gap H above the associating conveying wheels 12 toward the holder plate 35 of the card carrier unit 30. By means of controlling the starting point of the motors. 11 of the two conveying units 10, playing cars 3 are individually alternatively carried from the baffles 24 of the limiters 20 to the holder plate 35, and therefore playing cards 3 are shuffled automatically. When shuffling playing cards 3, the holder plate 35 is lowered with the slide 34 along the vertical sliding track 32 at a speed subject to the amount of playing cards 3 received. At this time, the arched constraint portions 43 of the constraint arm 42 hold playing cards 3 on the holder plate 35 neatly in a stack.

Figure 6:
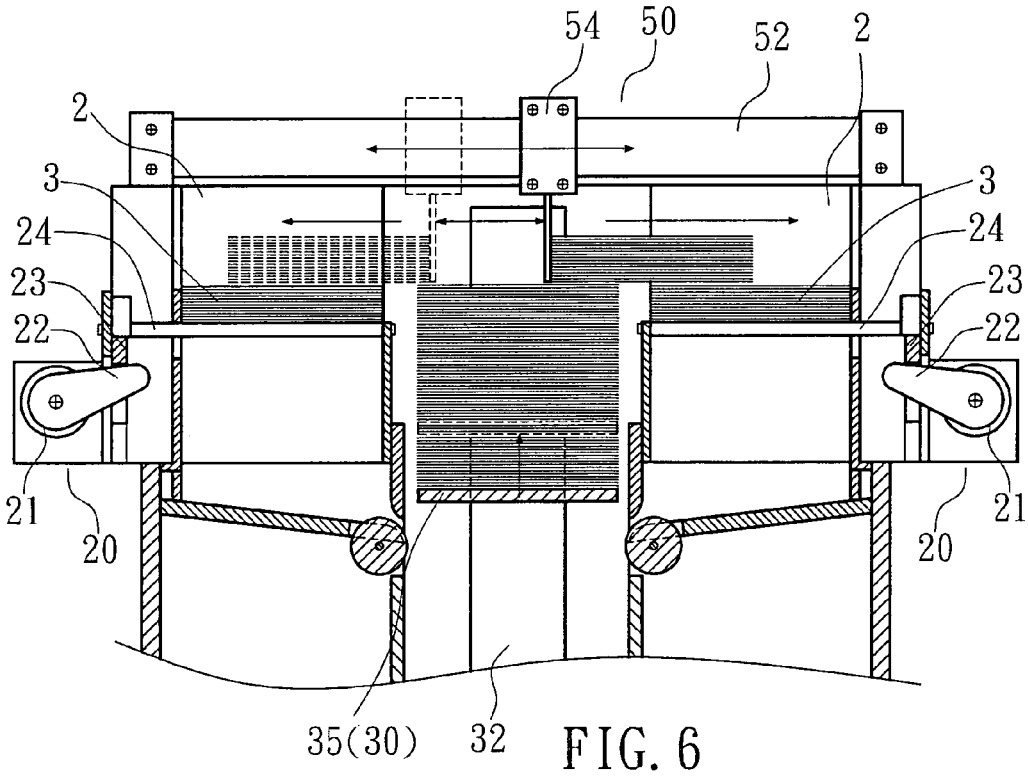
FIG. 6 is a schematic sectional view of the present invention, showing the cards lifted for a secondary shuffling.

After shuffling of playing cards 3, shuffled playing cards 3 can be shuffled again. At this time, as shown in FIG. 6, the card carrier unit 30 is operated to lift the holder plate 35 to a predetermined elevation adjust to the card dispensing mechanism 50, and then the motor 51 of the card dispensing mechanism 50 is operated to rotate the horizontal screw rod 53 forwards and backwards alternatively at a predetermined frequency, causing the push bar 55 to be moved with the slide 54 alternatively leftwards and rightwards, and therefore the push bar 55 pushes playing cards 3 to the baffles 24 of the limiters 20 in the working space 2 of each of the transparent stands 1, i.e., playing cards 3 are evenly distributed from the holder plate 35 to the baffles 24 and returned to the status shown in FIG. 3 for shuffling again.

According to this embodiment, the stands 1 are transparent. Alternatively, the stands 1 can be made opaque.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An automatic card shuffler comprising two stands arranged in parallel, said stands each defining a working space;

two conveying units respectively mounted in said stands in a bottom side of the working space of the associating stand, said conveying units each comprising two conveying wheels and a motor controllable to rotate said conveying wheels for conveying playing cards out of the associating stands toward a space between said stands;

two limiters respectively mounted in said stands at an outer side opposite to each other, said limiters each comprising a lifting frame, an actuating bar, a motor for turning said actuating bar to lift said lifting frame, and two baffles bilaterally pivoted to said lifting frame and inserted into the working space of the associating stands for holding playing cards above the conveying wheels of the associating conveying unit, said baffles being biased for letting playing cards fall therefrom to the conveying wheels of the associating conveying unit when the associating lifting frame is lowered in the working space of the associating stand to a predetermined elevation; and a card carrier unit set between said stands, said card carrier unit comprising a vertical sliding track, a vertical screw rod disposed in parallel to said vertical sliding track, a motor adapted to rotate said vertical screw rod, a slide coupled to said vertical screw rod and movable along said vertical sliding track upon rotation of the motor of said card carrier unit, and a holder plate affixed to the slide of said card carrier unit for collecting playing cards delivered from said conveying units.

2. The automatic card shuffler as claimed in claim 1, further comprising a card dispensing mechanism disposed above said stands, said card dispensing mechanism comprising a horizontal sliding track, a horizontal screw rod disposed in parallel to said horizontal screw rod, a reversible motor controllable to rotate said horizontal screw rod forwards and backwards, a slide coupled to said horizontal screw rod and movable along said horizontal sliding track upon rotation of the reversible motor of said card dispensing mechanism, and a push bar affixed to a bottom side of the slide of said card dispensing mechanism and adapted to push playing cards out of said holder plate of said card carrier unit into the working spaces of said stands alternatively.

3. The automatic card shuffler as claimed in claim 1, further comprising a constraint mechanism set between said stands, said constraint mechanism comprising a motor, a constraint arm coupled to the motor of said constraint mechanism and turnable by the motor of said constraint mechanism toward the holder plate of said card carrier unit to hold playing cards on said holder plate in a stack, said constraint arm having two arched constraint portions for holding playing cards on said holder plate in a stack.

* * * * *